US011725506B2

(12) United States Patent
Shahkarami et al.

(10) Patent No.: US 11,725,506 B2
(45) Date of Patent: Aug. 15, 2023

(54) AUTOMATIC WELL CONTROL BASED ON DETECTION OF FRACTURE DRIVEN INTERFERENCE

(71) Applicant: Baker Hughes Oilfield Operations LLC, Houston, TX (US)

(72) Inventors: Alireza Shahkarami, Oklahoma City, OK (US); Robert Klenner, Edmond, OK (US); Hayley Stephenson, Oklahoma City, OK (US); Mahendra Joshi, Katy, TX (US); Glen Murrell, Cheyenne, WY (US); Ghazal Izadi, Palo Alto, CA (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 393 days.

(21) Appl. No.: 17/149,706

(22) Filed: Jan. 14, 2021

(65) Prior Publication Data

US 2022/0220846 A1 Jul. 14, 2022

(51) Int. Cl.
*E21B 43/26* (2006.01)
*E21B 49/00* (2006.01)
(Continued)

(52) U.S. Cl.
CPC ..... *E21B 49/003* (2013.01); *E21B 43/2605* (2020.05); *E21B 47/003* (2020.05); *E21B 47/02* (2013.01)

(58) Field of Classification Search
CPC .. E21B 43/26; E21B 2200/20; E21B 2200/22; E21B 43/2605; E21B 43/267;
(Continued)

(56) References Cited

U.S. PATENT DOCUMENTS 8,532,968 B2 9/2013 Oury et al.
10,607,170 B1 3/2020 Basu et al.
(Continued)

OTHER PUBLICATIONS

Mohaghegh, frac-hit Dynamic Modeling using Artificial Intelligence & Machine Learning, 2020, Unconventional Resources Technology Conference.*

(Continued)

*Primary Examiner* — Kipp C Wallace
(74) *Attorney, Agent, or Firm* — Crowe & Dunlevy, P.C.

(57) ABSTRACT

A method is provided for controlling the operation of an offset well located near an active well that is undergoing a hydraulic fracturing operation that may produce a fracture driven interference (FDI) event to the offset well. The method includes providing an FDI intervention system that includes a computer-implemented predictive model for determining a risk of the FDI event occurring during the hydraulic fracturing operation, calculating a risk-weighted FDI event cost of the FDI event impacting production from the offset well, and calculating a defensive intervention implementation cost to apply a defensive intervention on the offset well to mitigate harm from an FDI event. The method includes calculating a cost comparison based on a comparison of the defensive intervention implementation cost and the risk-weighted FDI event cost. The method concludes with automatically controlling the operation of the offset well with the FDI intervention system based on the cost comparison.

18 Claims, 5 Drawing Sheets

(51) Int. Cl.
*E21B 47/003* (2012.01)
*E21B 47/02* (2006.01)

(58) Field of Classification Search
CPC ..... E21B 43/261; G01V 99/005; G01V 2210/646; G01V 2210/1234; G01V 1/40
See application file for complete search history.

(56) References Cited

U.S. PATENT DOCUMENTS

| | | | | |
|---|---|---|---|---|
| 2013/0333879 | A1 | 12/2013 | Rasheed | |
| 2017/0096880 | A1 | 4/2017 | Ben et al. | |
| 2017/0247995 | A1 | 8/2017 | Crews et al. | |
| 2018/0113966 | A1* | 4/2018 | Reese | E21B 41/0092 |
| 2018/0142543 | A1 | 5/2018 | Gupta et al. | |
| 2018/0240021 | A1 | 8/2018 | Al-Harbi et al. | |
| 2018/0283169 | A1 | 10/2018 | Oguche et al. | |
| 2018/0284311 | A1 | 10/2018 | Echeverria Ciaurri et al. | |
| 2019/0128110 | A1 | 5/2019 | Spicer et al. | |
| 2019/0128112 | A1 | 5/2019 | Spicer et al. | |
| 2019/0153840 | A1 | 5/2019 | Bacon et al. | |
| 2019/0153841 | A1 | 5/2019 | Randall et al. | |
| 2019/0234194 | A1 | 8/2019 | Dusterhoft et al. | |
| 2021/0189874 | A1* | 6/2021 | Jaaskelainen | E21B 47/135 |
| 2021/0364669 | A1* | 11/2021 | Dusterhoft | E21B 49/00 |
| 2022/0083873 | A1* | 3/2022 | Ramey | G06N 20/00 |
| 2022/0365239 | A1* | 11/2022 | Rose | E21B 49/00 |
| 2023/0020671 | A1* | 1/2023 | Korkin | E21B 43/26 |

OTHER PUBLICATIONS

Tyree, "Predicting Frac Hits Using Artifificial Intelligence; Application in Marcellus Shale", 2018, West Virginia University Graduate Theses.*

Klenner, Rob et al., Characterization of Fracture-Driven Interference and the Application of Machine Learning to Improve Operational Efficiency, Society of Professional Engineers (2018).

Gala et al., "Modeling of fluid injection in depleted parent wells to minimize damage due to frac-hits," Unconventional Resources Technology Conference, Houston, TX, Society of Exploration Geophysicists, American Association of Petroleum Geologists, Society of Petroleum Engineers, Jul. 23-25, 2018, pp. 1-14.

Search Report and Written Opinion; ISA/KR; PCT/US2022/070111; dated Apr. 19, 2022.

Dongbo et al., Well Type and Pattern Optimization Technology for Large Scale Tight Sand Gas, Sulige Gas Field, NW China, Petroleum Exploration and Development; vol. 40, Issue 1, Feb. 2013.

Xu et al., Advanced Modeling of Production Induced Pressure Depletion and Well Spacing Impact on Infill Wells in Spraberry, Permian Basin, SPE Annual Technical Conference, Sep. 24, 2018.

Lehmann et al., Expanding Interpretation of Interwell Connectivity and Reservoir Complexity through Pressure Hit Analysis and Microseismic Integration; SPE Hydraulic Fracturing Conference, Feb. 1, 2016.

* cited by examiner

AUTOMATIC WELL CONTROL BASED ON DETECTION OF FRACTURE DRIVEN INTERFERENCE

FIELD OF THE INVENTION

This invention relates generally to the field of oil and gas production, and more particularly, but not by way of limitation, to a system and method for automatically adjusting the operation of offset wells based on actual or predicted fracture driven interference (FDI) events in a nearby active well.

BACKGROUND

Boreholes or wellbores are drilled into subsurface geologic formations that contain reservoirs of hydrocarbons to extract the hydrocarbons. Typically, a first set of wellbores are distributed over an area that is believed to define the boundaries of a reservoir block, or an operator's interest in the reservoir block. These existing or "parent" wellbores generally have a horizontal component that extends into the reservoir. A second set of wellbores may be drilled beside the parent wellbores to increase the production of hydrocarbons and fully exploit the reservoir asset. The second set of wellbores may be referred to as infill or "child" wellbores. The term "offset well" refers generally to an existing well that is located in the proximity of an "active" well that is being drilled or undergoing completion services (e.g., hydraulic fracturing)

Hydraulic fracturing may be used to improve the recovery of hydrocarbons from the active infill wells. "Frac hits" are a form of fracture-driven interference (FDI) that occur when infill (active) wells communicate with existing (offset) wells during completion. The frac hits may negatively or positively affect production from the existing wells. In some cases, pressure communication between adjacent wellbores will result in an increase in pressure in the passive well, with a loss of fracturing fluid and proppant from the active well undergoing the hydraulic fracturing operation. This may lead to a decrease in production from the passive or offset well due to the increased presence of sand and proppant in the well, or from the active well due to ineffective stimulation.

To minimize the risk of adverse effects within offset wells, operators often shut-in offset wells while the active infill well is being hydraulically fractured. Shutting in the offset well may limit the ingress of fluids and proppant from the active well. In other situations, operators may deploy defensive measures to offset wells to further reduce the risk of adverse effects from FDI events. Defensive measures may include injecting fluids into the offset well to increase pressure within the offset well to discourage the inflow of proppant and high pressure frac fluids from the active well. In either case, deploying defensive measures or shutting in the well results in downtime and lost or deferred production.

The causation and impact of FDI events are not well understood. Operators tend to apply an ad-hoc strategy for well protection that leads to negative economic impact in terms of deferred production and excessive intervention costs. There is, therefore, a need for an improved well management system that facilitates and automates the decisions and deployment of interventions in offset wells. It is to these and other deficiencies in the prior art that the present embodiments are directed.

SUMMARY OF THE INVENTION

In one aspect, the present invention provides a method of controlling the operation of an offset well located near an active well that is undergoing a hydraulic fracturing operation that may produce a fracture driven interference (FDI) event to the offset well. The method is intended to optimize the economic recovery of hydrocarbons from the active well and the offset well. The method comprises the steps of providing an FDI intervention system that includes a computer-implemented predictive model for determining a risk of the FDI event occurring during the hydraulic fracturing operation. The method also includes the steps of calculating a risk-weighted FDI event cost of the FDI event impacting production from the offset well, and calculating a defensive intervention implementation cost to apply a defensive intervention on the offset well to mitigate harm from an FDI event. The method further includes the step of calculating a cost comparison based on a comparison of the defensive intervention implementation cost and the risk-weighted FDI event cost. The method concludes with the step of automatically controlling the operation of the offset well with the FDI intervention system based on the cost comparison.

In another aspect, the exemplary embodiments include a method of controlling the operation of an offset well located near an active well that is undergoing a hydraulic fracturing operation that may produce a fracture driven interference (FDI) event to the offset well, where the method is intended to optimize the economic recovery of hydrocarbons from the active well and the offset well. The method begins with the step of providing an FDI intervention system that includes a computer-implemented predictive model for determining a risk of the FDI event occurring during the hydraulic fracturing operation. Next, the method includes the steps of calculating a risk-weighted FDI event cost of the FDI event impacting production from the offset well, and calculating a defensive intervention implementation cost to apply a defensive intervention on the offset well to mitigate harm from an FDI event. Next, the method includes the step of calculating a cost comparison based on a comparison of the defensive intervention implementation cost and the risk-weighted FDI event cost. The method concludes with the step of automatically controlling the operation of the offset well by applying the defensive intervention to the offset well if the calculated cost comparison determines that the defensive intervention implementation cost is less than the risk-weighted FDI event cost.

In other embodiments, the exemplary embodiments include an FDI intervention system for automatically controlling the operation of an offset well located near an active well that is undergoing a hydraulic fracturing operation that may produce a fracture driven interference (FDI) event to the offset well. The FDI intervention system includes a plurality of pressure sensors configured to monitor the pressure in the active well and in the offset well, a plurality of automated controls configured to adjust the operation of the offset well, a well intervention mechanism connected to the offset well, and an analysis module that includes a predictive model for determining an FDI event risk representative of an FDI event occurring between the active well and the offset well. The analysis module is configured to automatically control the plurality of automated controls based in part on the FDI event risk.

BRIEF DESCRIPTIONS OF THE DRAWINGS

WRITTEN DESCRIPTION

Figure 1:
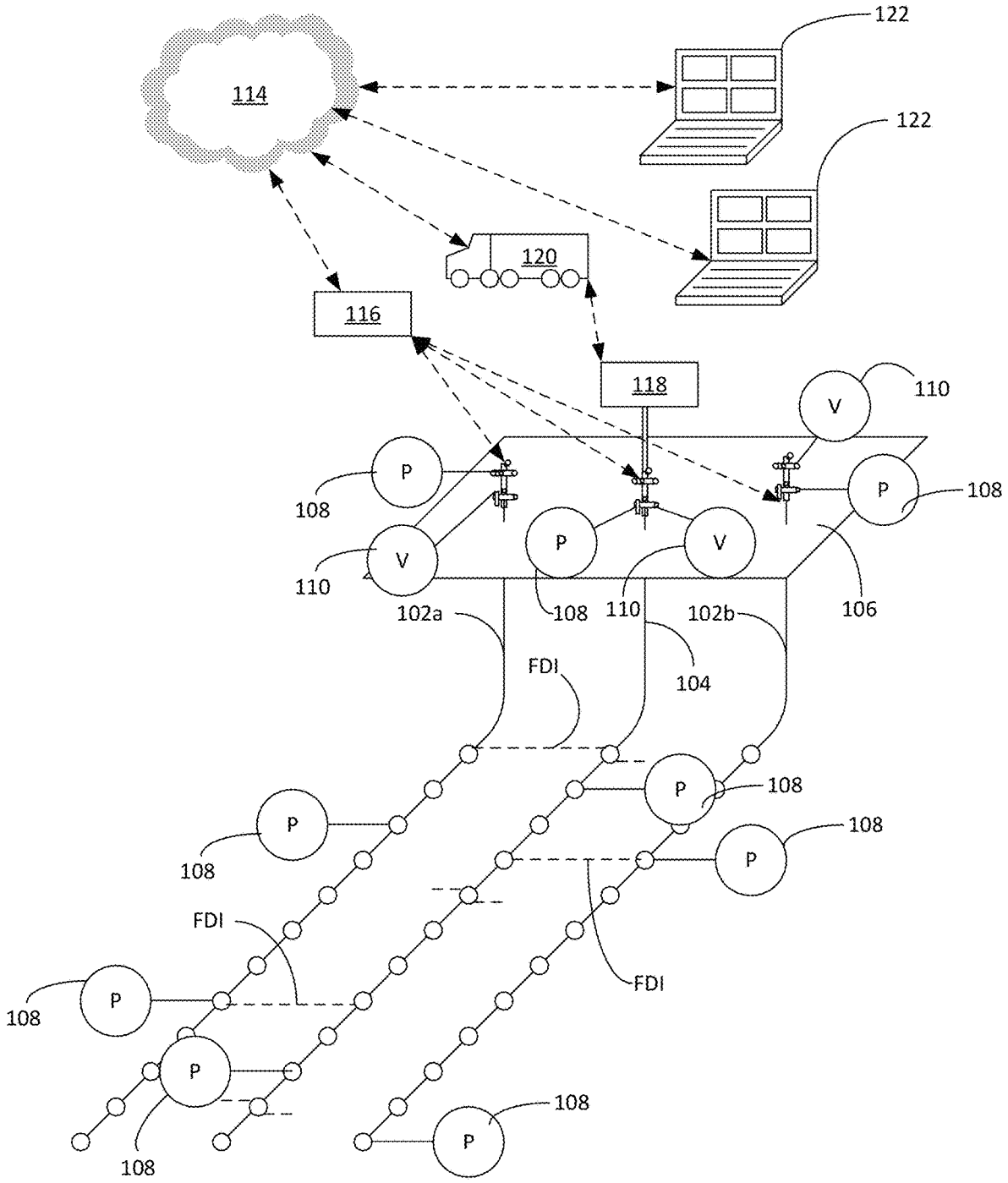
FIG. 1 is a depiction of a series of wells connected to an FDI intervention system.

In accordance with an exemplary embodiment, FIG. 1 illustrates an automated fracture driven interference (FDI) intervention system 100 deployed to optimize the production from one or more offset wells 102 that are positioned near an active well 104. The active well 104 is undergoing a hydraulic fracturing operation, while the one or more offset wells 102 have already been completed. As depicted, the active well 104 is a second infill well that is positioned between the offset wells 102*a*, 102*b* (which may be, for example, a parent well and an earlier infill well). The active well 104 and offset wells 102 extend from a common well pad 106. FIG. 1 indicates that one frac hit (an "FDI event") occurred between active well 104 and offset well 102*b* and two frac hits occurred between active well 104 and offset well 102*a*.

It will be appreciated that the wells depicted in FIG. 1 are merely an example of how the FDI intervention system 100 can be deployed, and that the systems and methods of the exemplary embodiments will find utility in other arrangements of closely-drilled wells. For example, the FDI intervention system 100 can be used to actively monitor hydraulic fracturing operations carried out contemporaneously on multiple active wells 102. As used herein, the term "wells" collectively refers to the offset wells 102*a*, 102*b* and the active well 104.

Each well includes one or more pressure sensors 108 that measure the pressure at a specific location or region within the well. As illustrated in FIG. 1, each well is divided into a plurality of stages for hydraulic fracturing and production operations. Automated controls 110 are also included on each of the wells. The automated controls 110 may include control valves, chokes and other equipment that can be activated to close, open, and treat the wells. For example, the automated controls 110 on the offset wells 102 can be remotely activated to shut in the offset wells 102, or place the offset wells 102 in fluid communication with a well intervention mechanism 112. The well intervention mechanism 112 can include pressurized injection fluids such as super critical carbon dioxide, nitrogen, steam, hydrocarbon fluids (including crude fluids, diesel, wellhead gas, and natural gas), water, and brine, as well as treatment and stimulation chemicals. In other embodiments, the well intervention mechanism 112 includes equipment and materials useful in carrying out "refrac" operations on the offset wells 102, in which pressurized hydraulic fracturing fluids and proppants are injected into the offset wells 102.

The pressure sensors 108 are configured to report on a continuous or periodic basis the measured pressure to a computer-implemented analysis module 114 which also contains a database of field level data. In the exemplary embodiment depicted in FIG. 1, the analysis module 114 is configured as one or more remote computers that are accessed via a cloud computing network. A local communications system 116 may be used to gather and transfer the raw data between the pressure sensors 108 and the automated controls 110 and the analysis module 114 using commercially available telecommunications networks and protocols (e.g., the ModBus protocol). In other embodiments, some or all of the pressure sensors 108 and automated controls 110 connect directly to the remote analysis module 114 through a direct network connection without an intervening location communications system 116.

Hydraulic fracturing equipment 118 is positioned near that active well 104 and controlled from a control station 120. In many applications, the control station 120 is a "frac van" that provides the operators with control and live information about the hydraulic fracturing operation. A number of performance criteria can be adjusted by the control station 120, including, for example, the makeup of the fracturing fluids and slurry, the types and quantities of sand or proppant injected into the active well 104, and the pumping pressures and flowrates achieved during the hydraulic fracturing operation. Each of these criteria is referred to herein as an "operational variable" that relates to the active hydraulic fracturing operation. The control station 120 is also connected to the analysis module 114, either directly or through the local telecommunications system 116.

Although the analysis module 114 is depicted as a cloud-computing resource in FIG. 1, in other embodiments the analysis module 114 is positioned locally in close proximity to the wells and control station 120. Positioning the analysis module 114 near the wells may reduce the latency between the time the live data is measured and the time the data is processed by the analysis module 114. In contrast, positioning the analysis module 114 in the cloud or at an offsite location may enable the use of more powerful computing systems. In yet other embodiments, some of the processing is carried out using local computers configured in an "edge-based" architecture near the wells, while the balance of the processing takes place at a remote location.

One or more workstations 122 are connected to the analysis module 114 either through a local direct connection or through a secure network connection. The workstations 122 are configured to run a computer-implemented FDI intervention program that provides a user with real-time information produced by the analysis module 114. The workstations 122 can be positioned in different locations. In some embodiments, some of the workstations 122 are positioned in remote locations from the wells, while other workstations are positioned near the wells in the control station 120 or as part of a local edge-based computing system. As used herein, the term "workstations" includes personal computers, thin client computers, mobile phones, tablets, and other portable electronic computing devices.

As used herein, the term "FDI intervention system 100" refers to a collection of at least two or more of the following components: the pressure sensors 108, the automated controls 110, the well intervention mechanisms 112, the control station 120, the analysis module 114, the workstations 122 and any intervening data networks such as the local telecommunications system 116. It will be appreciated that the FDI intervention system 100 may include additional sensors and controls in or near the active well 104 and the offset wells 102. Such additional sensors may include, for example, microseismic sensors, temperature sensors, proppant or fluid tracer detectors, acoustic sensors, and sensors located in artificial lift, completion, or other downhole equipment in the wells. The data measurement signal data provided by such additional sensors is transmitted to the analysis module 114 directly or through intervening data networks.

As explained below, the FDI intervention system 100 is generally configured to monitor a hydraulic fracturing operation on the active well 104, determine the likelihood of an FDI event occurring between the active well 104 and one or more offset wells 102, develop one or more defensive intervention protocols designed to protect the potentially affected offset wells 102, compare the relative economic impacts of proceeding with, and without, deployment of the defensive intervention protocols, and then controlling the operation of the active well 104 and offset wells 102 according to the selected well control protocols based on the determination of which option presents the lowest aggregate risk of an adverse economic impact. In exemplary embodiments, the FDI intervention system 100 is configured to automatically perform this comparative analysis in real time and implement the selected well control protocol on the offset wells 102 without direct human direction.

Defensive intervention protocols include, but are not limited to, the injection of pressurized injection fluids into the offset well 102 (e.g., super critical carbon dioxide, nitrogen, wellhead gas, natural gas, steam, water, and brine), the injection of well treatment and stimulation chemicals into the offset well 102 (e.g., surfactants, soaps, and friction reducers), partially or completely shutting in (closing) the offset wells 102, delaying or modifying the completion plan for the offset well 102, and carrying out new or "refrac" hydraulic fracturing operations on the offset well 102. It will be appreciated that this is a non-exhaustive list of defensive intervention protocols. It will be further appreciated that two or more of these defensive intervention protocols may be carried out simultaneously or in sequence, and that the defensive intervention protocols can be applied to multiple offset wells 102 as part of a comprehensive plan covering a plurality of potentially impacted offset and active wells 102, 104.

Before the hydraulic fracturing operation takes place, an operator of the FDI intervention system 100 using the workstation 122 can connect the analysis module 114 to the control station 120 and to a selected number of the pressure sensors 108 in the active well 104 and the offset wells 102. Once the hydraulic fracturing operation has been initiated, the analysis module 114 can poll the control station 120 and pressure sensors 108 on a continuous or periodic basis. In some embodiments, the analysis module 114 polls the pressure sensors on intervals of between once per second and once per every fifteen minutes. In an exemplary embodiment, the analysis module 114 pulls the pressure sensors 108 every thirty seconds. The raw data from the control station 120 and pressure sensors 108 is provided to the analysis module 114 for processing. The analysis module 114 is generally configured to detect anomalies in the pressure measurements taken by the pressure sensors in the offset wells 102. In some embodiments, the analysis module 114 applies simple rule-based analytics in which recommended actions are determined based on inputs received from the control station 120 and pressure sensors 108. In other embodiments, the analysis module 114 invokes machine learning, simulated physics engines, or statistical functions to detect FDI events based on pressure anomalies and to autonomously determine a causal relationship between the FDI events and one or more features of the hydraulic fracturing operation and the wells.

Figure 2:
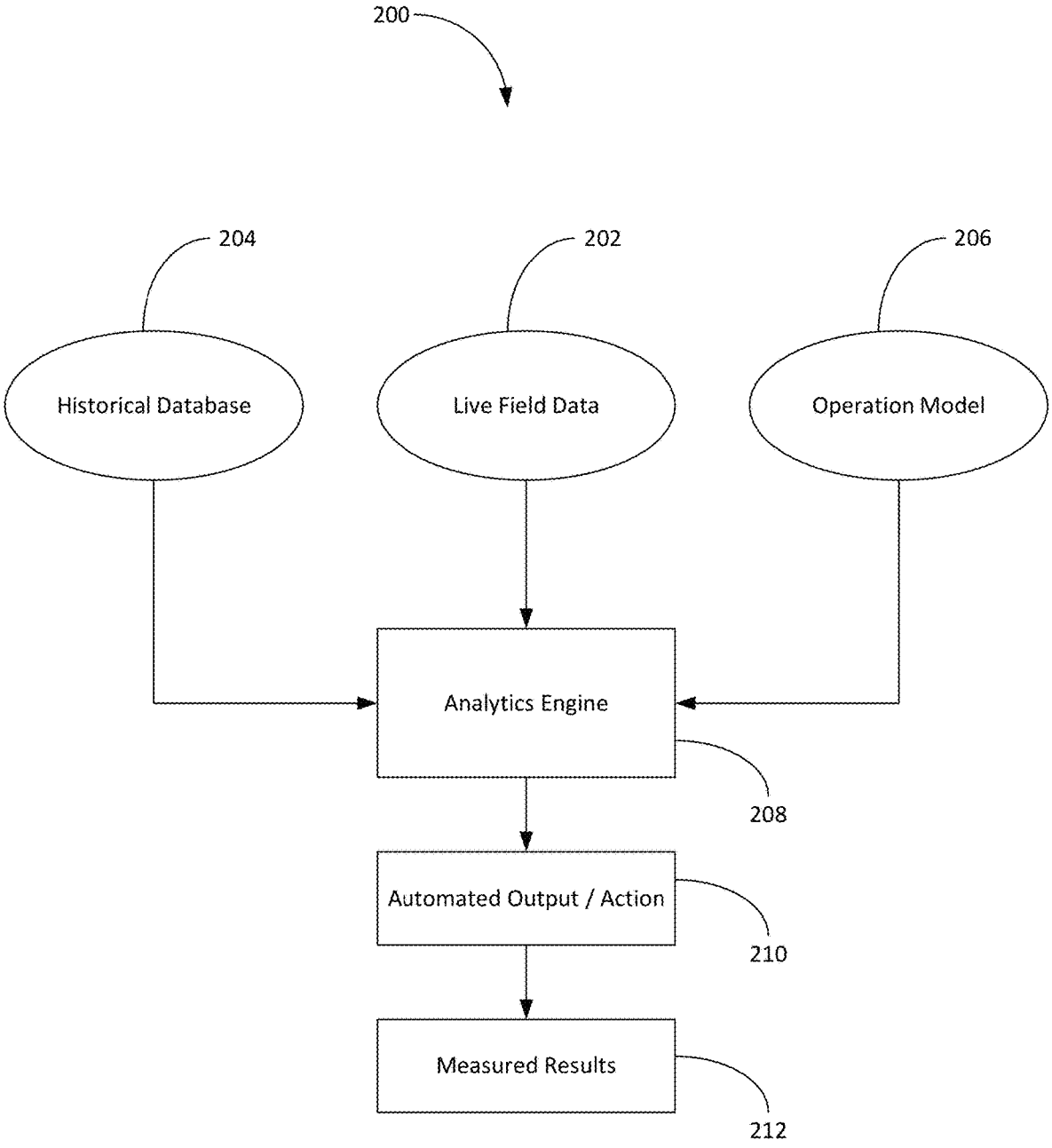
FIG. 2 is a diagram for an overview of the process for determining and applying an optimized well intervention strategy.

Thus, with reference to FIG. 2, the analysis module 114 of the FDI intervention system 100 is generally configured to carry out an optimized well control operation 200 by receiving: (i) inputs from live field data at block 202 (e.g., pressures sensors 108, automated controls 110); (ii) information from historical databases at block 204 that correlate the economic impacts from past stimulation and intervention activities in relevant hydrocarbon producing geologic formations; and (iii) information about the planned hydraulic fracturing operation at block 206 to be carried out on the active well 104, and the potential defensive intervention protocols available for deployment on the offset wells 102. The analysis module 114 is optimally configured to apply machine learning and neural networks to the various inputs to the analysis module 114 at block 208 to produce one or more recommendations at block 210. The recommended well control protocols can be manually or automatically implemented to optimize the production of hydrocarbons from the offset wells 102 and active well 104. Once the selected well control protocol has placed into operation, the results of the operation are studied at block 212 and used to update the inputs to the analysis module 114 for further iterations of the FDI intervention system 100.

Figure 3:
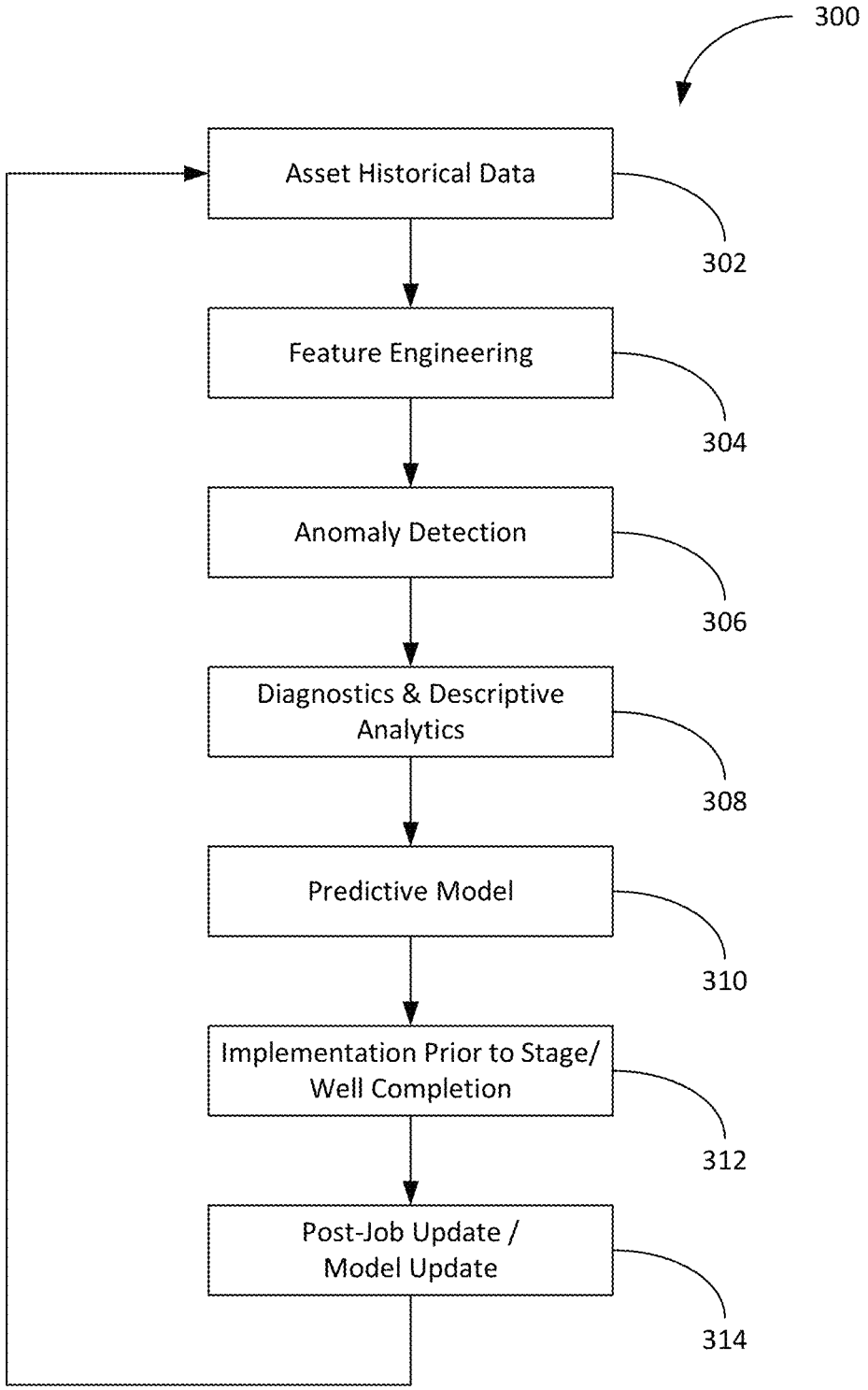
FIG. 3 is process flow diagram for developing an integrated predictive model for evaluating the risk of FDI events, the outcome of FDI events, and the impact of defensive interventions.

Turning to FIG. 3, shown therein is a process flow diagram for a predictive analytics model development process 300. The process begins at step 302, when historical data relevant to the assets (e.g., pressure readings from the offset wells 102 and the active well 104) are gathered together. At step 304, features and parameters for the model are developed based on a number of factors related to the production of hydrocarbons from the wells, including for example, production goals, completion strategies, well spacing, well construction, drilling techniques and progress, well depletion and stress, and reservoir-specific properties (e.g., porosity, depth, etc.).

Based on these features, parameters and the historical data, the model development process 300 finds correlations between features and historical data and evidence of actual FDI events that occurred in the historical data at step 306. Confirming data that establishes the likelihood of an FDI event can be acquired using tracer fluid mechanisms, fiber optics, pressure response analysis and production response analysis. Based on these correlations, the process 300 ranks features and parameters at step 308.

At step 310, the process establishes a predictive model using machine learning algorithms that may include support vector machines (SVMs), random forest determinations, and artificial neural networks. The predictive model is iteratively established at step 310 based on a number of inputs, including completion strategy, normalized completion parameters, well characteristics, reservoir quality, distance, and depletion history. The predictive model is configured to output a number of probabilities, including the risk of an FDI event, the cost and availability of potential defensive intervention protocols to mitigate the harm caused by an FDI event, the risk of disruptions to production in the offset wells 102 if no defensive intervention protocol is implemented, and the risk of disruptions and deferred production caused by the implementation of one or more defensive intervention protocols. Importantly, the predictive model can be configured to produce composite predictions that include both the chance of particular events occurring and the relative costs and benefits associated with those events and the potential interventions. In this way, the computer-implemented model can be configured to output an array or spectrum of predictions that include both probability and cost/benefit factors. For example, the analysis module 114 may determine that a defensive intervention protocol that presents a significant risk of causing a slight disruption to production from the offset well 102 should be deployed in hopes of mitigating harm caused by an FDI event that is very unlikely to occur, but which would result in significant disruptions if the FDI event occurs.

It is important to note that in certain situations, the analysis module 114 may determine that a particular FDI event would be beneficial to the offset wells 102. If, for example, the analysis module 114 determines that an FDI event would stimulate or otherwise increase the production of hydrocarbons from the offset well 102, the analysis module 114 can produce a recommendation (e.g., a "negative" value within a cost determination construct) that includes the potential benefits to be achieved by the occurrence of the predicted FDI event. The state or operation of the offset well 102 can be automatically adjusted in response to the recommendation from the analysis module 114 to optimize the benefits received through the predicted FDI event.

At step 312, a selected set of recommendations (e.g., whether to implement a recommended defensive intervention protocol) is implemented on at least some of the offset wells 102 and the active well 104. Once implemented, the results of the hydraulic fracturing operation on the active well 104 and the impact, if any, on the offset wells 102 is measured. This information may include changes in downhole pressure in the offset wells 102 indicative of an FDI event, cost of production loss from the offset wells 102, complications from the hydraulic fracturing operation on the active well 104, and the cost of implementing a defensive intervention protocol on the offset wells 102. This information can then be stored, processed, analyzed and used as inputs within the next iteration of the predictive model at step 310.

Figure 4:
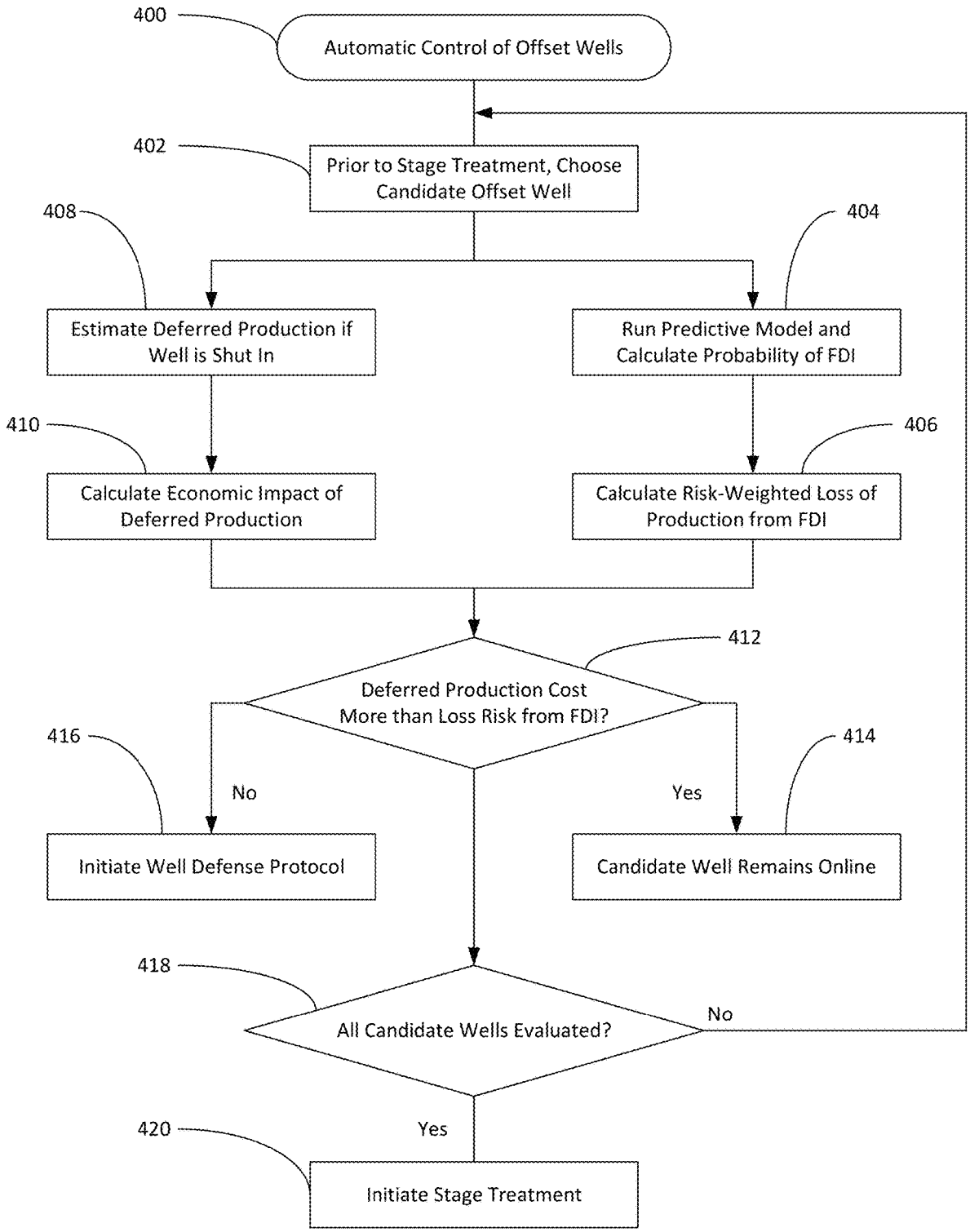
FIG. 4 is a process flow diagram for an automated method for controlling offset wells.

Turning next to FIG. 4, shown therein is a process flowchart for a method 400 for the automatic control of the offset wells 102 using the FDI intervention system 100. The method 400 begins at step 402, when a "candidate" offset well 102 is selected for analysis using the FDI intervention system 100. The candidate well is selected before the next stage of the completion operation (e.g., hydraulic fracturing) is carried out on the active well 104. Once the candidate offset well 102 has been selected, the method 400 splits into two sequences, which may be carried out in parallel or series. In one sequence, the FDI intervention system 100 determines at step 404 the probability of an FDI event occurring at the candidate offset well 102 during the upcoming completion stage on the active well 104. At step 406, the FDI intervention system 100 provides a prediction of the costs caused by the loss of production if the FDI event occurs and disrupts production from the candidate offset well 102. In this way, the FDI intervention system 100 produces a "risk-weighted loss of production" that may be caused by an FDI event if the candidate offset well 102 remains online with no defensive intervention during the next stage of completion on the active well 104.

In the other sequence, at step 408 the FDI intervention system 100 estimates the deferred production if the candidate offset well 102 is shut-in or if a defensive intervention protocol is applied. At step 410, the FDI intervention system 100 estimates the economic impact of deferred production caused by shutting in the candidate offset well 102 or applying a defensive intervention that temporarily disrupts or diminishes production from the offset well 102. The cost calculated at step 410 may include cost of materials and labor for implementing the defensive intervention protocol.

At step 412, the FDI intervention system 100 analyzes the risk-weighted costs of proceeding with and without interventions on the candidate offset well 102. If the projected loss from shutting in or intervening in the production from the candidate offset well 102 exceed the risk-weighted loss from an unmitigated FDI event impacting the candidate offset well 102, the FDI intervention system 100 recommends leaving the candidate offset well 102 online at step 414 during the upcoming completion stage on the active well 104. If, however, the FDI intervention system 100 determines that the risk-weighted loss from an FDI event exceeds the cost resulting from shutting in or applying a defensive intervention protocol on the candidate offset well 102, the FDI intervention system 100 recommends applying the defensive protocol on the candidate offset well 102 at step 416.

In some embodiments, steps 402-416 are automated and the recommendations in steps 414 and 416 are carried out without human intervention by sending the appropriate command signals to the automated controls 110 and well intervention mechanism 112. In other embodiments, the FDI intervention system 100 is configured to produce a written report, visual display or other human-oriented output without automatically implementing the recommendations from step 412. The operator can then manually apply a selected set of recommendations made by the analysis module 114.

In situations where there are multiple offset wells 102, the method 400 moves to step 418 where the FDI intervention system 100 determines if all of the candidate offset wells 102 have been evaluated using the method 400. Once all the candidate offset wells 102 have been evaluated using the method 400, the method proceeds to step 420 and the next treatment stage of the completion operation is carried out on the active well 104. In some embodiments, the FDI intervention system 100 is configured to automatically initiate the next stage of the treatment operation on the active well 104 by sending the appropriate command signal to the hydraulic fracturing equipment 118 and control station 120.

Figure 5:
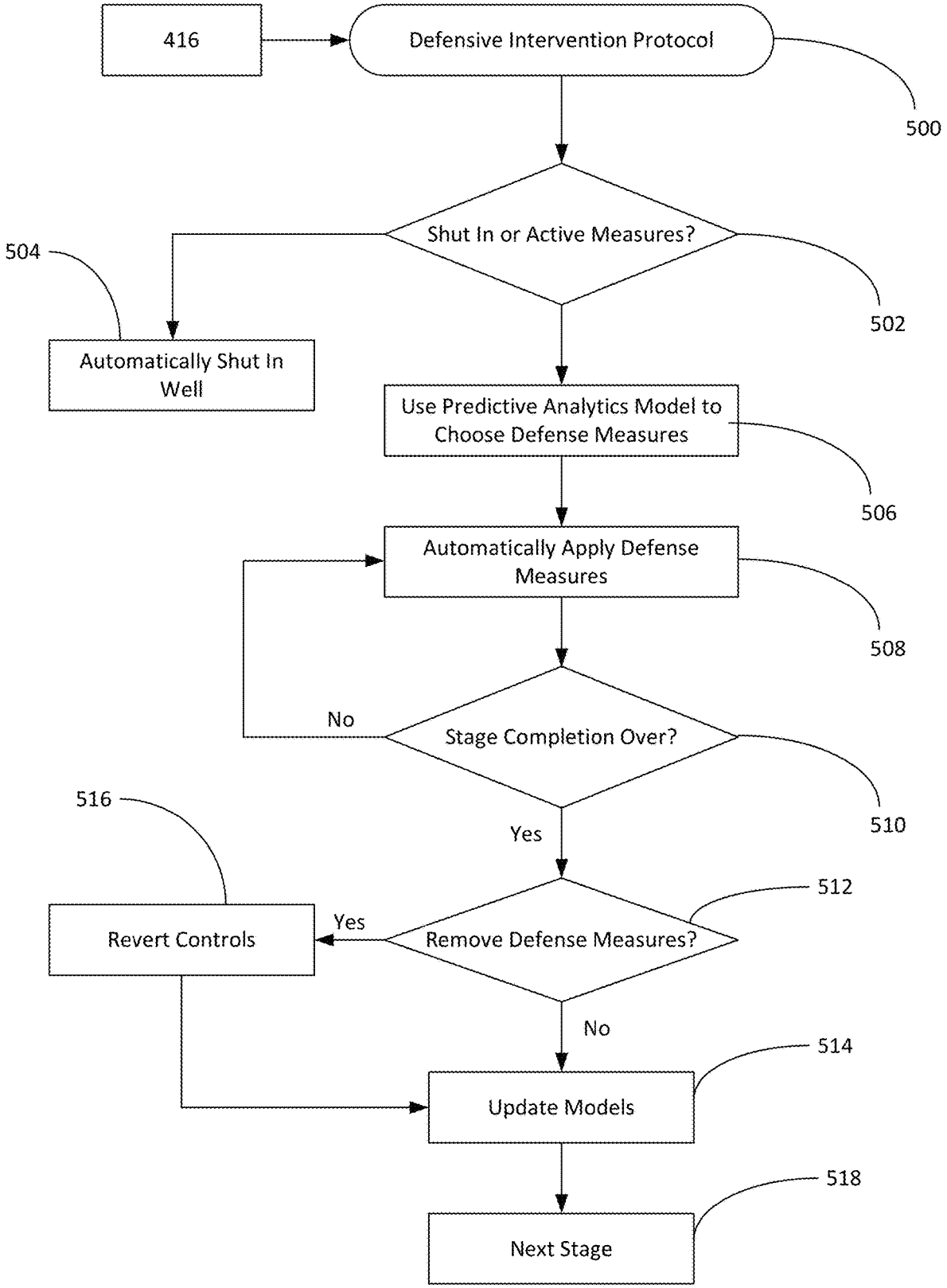
FIG. 5 is a process flow diagram for automatically applying a defensive intervention on an offset well.

Turning to FIG. 5, shown therein is a process flow diagram for a process 500 of applying a defensive intervention protocol that originated from step 416 of the method 400. At step 502, the FDI intervention system 100 determines if the candidate offset well 102 should be temporarily shut in at step 504, or if a defensive intervention will be applied to the candidate offset well at step 506. If the FDI intervention system 100 recommends shutting in the candidate offset well 102 at step 504, the FDI intervention system 100 sends the appropriate command signals to the automated controls for the candidate offset well 102 to shut in the well (e.g., through an automated choke or control valve).

If the FDI intervention system 100 recommends applying a defensive intervention, the FDI intervention system 100 provides a recommended defensive intervention based on the predictive analytics derived from machine learning. Once the recommended defensive intervention has been identified, the method 500 moves to step 508 and the defensive intervention is applied. In exemplary embodiments, the defensive intervention is automatically applied by the FDI intervention system 100 through signals sent to the automated controls 110 and well intervention mechanism 112. As noted above, the application of the selected defensive intervention can also be manually applied by an operator responding to a recommendation report generated by the FDI intervention system 100. In some embodiments, the FDI intervention system 100 is configured to present a plurality of defensive intervention options for consideration by the human operator.

Once the selected defensive intervention is applied, the method 500 proceeds to step 510 when the FDI intervention system 100 determines if the completion stage on the active well 104 is finished. The method 500 loops back to step 508 until the completion stage is finished. Once the completion stage on the active well 104 is finished, the method 500 moves to step 512 to determine if the implemented defensive intervention should be removed or withdrawn. In some situations, the FDI intervention system 100 may determine that it is more efficient to leave the defensive intervention in place on the candidate offset well 102 in anticipation of activity on a subsequent completion stage on the active well 104.

If the FDI intervention system 100 determines that the defensive intervention should remain in place, the method 500 moves to step 514. If the FDI intervention system 100 determines that the defensive intervention should be withdrawn, the method 500 moves to step 516 and the candidate offset well 102 is placed back into production by opening the well or removing the defensive intervention. The method 500 then proceeds to step 514, where information recorded in the offset well 102 and active well 104 is used to update the predictive models used by the FDI intervention system 100. At step 518, the method 500 resets for the next completion stage on the active well 104.

Thus, in these exemplary embodiments, the FDI intervention system 100 determines the likelihood of an FDI event occurring between the active well 104 and one or more offset wells 102, evaluates or develops one or more defensive intervention protocols designed to protect the potentially affected offset wells 102, compares the relative economic impacts of proceeding with, and without, deployment of the various defensive intervention protocols, and then controls the operation of the active well 104 and offset wells 102 according to the selected well control protocols based on the determination of which option presents the lowest risk-weighted cost (adverse economic impact) on the offset wells 102. Although the FDI intervention system 100 is well suited for use in connection with FDI events triggered by hydraulic fracturing, the FDI intervention system may also find utility in monitoring and optimizing injection procedures implemented during enhanced oil recovery (EOR) operations.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

What is claimed is:

1. A method of controlling the operation of an offset well located near an active well that is undergoing a hydraulic fracturing operation that may produce a fracture driven interference (FDI) event to the offset well, wherein the method is intended to optimize the economic recovery of hydrocarbons from the active well and the offset well, the method comprising the steps of:

providing an FDI intervention system that includes a computer-implemented predictive model for determining a risk of the FDI event occurring during the hydraulic fracturing operation;

calculating a risk-weighted FDI event cost of the FDI event impacting production from the offset well;

calculating a defensive intervention implementation cost to apply a defensive intervention on the offset well to mitigate harm from the FDI event;

calculating a cost comparison based on a comparison of the defensive intervention implementation cost and the risk-weighted FDI event cost; and automatically controlling the operation of the offset well with the FDI intervention system based on the cost comparison.

2. The method of claim 1, wherein the step of automatically controlling the operation of the offset well comprises applying the defensive intervention to the offset well if the calculated cost comparison determines that the defensive intervention implementation cost is less than the risk-weighted FDI event cost.

3. The method of claim 2, wherein applying the defensive intervention to the offset well comprises shutting in the offset well.

4. The method of claim 2, wherein applying the defensive intervention to the offset well comprises injecting pressurized fluids into the offset well to increase the pressure within the offset well.

5. The method of claim 4, wherein applying the defensive intervention to the offset well comprises conducting a refrac operation on the offset well.

6. The method of claim 1, wherein the step of automatically controlling the operation of the offset well comprises not applying the defensive intervention to the offset well if the calculated cost comparison determines that the defensive intervention implementation cost is more than the risk-weighted FDI event cost.

7. The method of claim 1, wherein the step of calculating a defensive intervention implementation cost comprises evaluating a deferred production cost from temporarily shutting in the offset well.

8. The method of claim 7, wherein the step of calculating a defensive intervention implementation cost further comprises evaluating a material and labor cost of implementing the defensive intervention protocol.

9. The method of claim 1, wherein the step of providing an FDI intervention system that includes a computer-implemented predictive model for determining a risk of the FDI event occurring during the hydraulic fracturing operation further comprises using machine learning to develop the computer-implemented predictive model.

10. The method of claim 9, wherein the step of using machine learning to develop the computer-implemented predictive model comprises correlating a risk of an FDI event with feature engineering inputs.

11. The method of claim 10, wherein the step of using machine learning to develop the computer-implemented predictive model further comprises using artificial neural networks, support vector machines, or random forest determinations.

12. The method of claim 9, wherein the step of using machine learning to develop the computer-implemented predictive model comprises correlating a risk of an FDI event with anomalies detected within the active well or the offset well.

13. The method of claim 9, wherein the step of using machine learning to develop the computer-implemented predictive model comprises correlating a risk of an FDI event based on a completion strategy for the active well.

14. The method of claim 9, wherein the step of using machine learning to develop the computer-implemented predictive model comprises correlating a risk of an FDI event based on a set of wellbore characteristics for the active well.

15. A method of controlling the operation of an offset well located near an active well that is undergoing a hydraulic fracturing operation that may produce a fracture driven interference (FDI) event to the offset well, wherein the method is intended to optimize the economic recovery of hydrocarbons from the active well and the offset well, the method comprising the steps of:

providing an FDI intervention system that includes a computer-implemented predictive model for determining a risk of the FDI event occurring during the hydraulic fracturing operation;

calculating a risk-weighted FDI event cost of the FDI event impacting production from the offset well;

calculating a defensive intervention implementation cost to apply a defensive intervention on the offset well to mitigate harm from the FDI event;

calculating a cost comparison based on a comparison of the defensive intervention implementation cost and the risk-weighted FDI event cost; and automatically controlling the operation of the offset well by applying the defensive intervention to the offset well if the calculated cost comparison determines that the defensive intervention implementation cost is less than the risk-weighted FDI event cost.

16. The method of claim 15, wherein applying the defensive intervention to the offset well comprises shutting in the offset well.

17. The method of claim 15, wherein applying the defensive intervention to the offset well comprises injecting pressurized fluids into the offset well to increase the pressure within the offset well.

18. The method of claim 14, wherein the step of calculating a defensive intervention implementation cost comprises evaluating a deferred production cost from temporarily shutting in the offset well.

* * * * *